US011613831B2

(12) United States Patent
Gupta

(10) Patent No.: US 11,613,831 B2
(45) **Date of Patent: *Mar. 28, 2023**

(54) HIGH THREAD/YARN COUNT WOVEN TEXTILE FABRIC AND PROCESS OF PREPARATION THEREOF

(71) Applicant: Ronak Rajendra Gupta, Mumbai (IN)

(72) Inventor: Ronak Rajendra Gupta, Mumbai (IN)

( * ) Notice: Subject to any disclaimer, the term of this patent is extended or adjusted under 35 U.S.C. 154(b) by 101 days.

This patent is subject to a terminal disclaimer.

(21) Appl. No.: 17/079,910

(22) Filed: Oct. 26, 2020

(65) Prior Publication Data

US 2021/0040656 A1 Feb. 11, 2021

Related U.S. Application Data

(60) Continuation-in-part of application No. 16/265,537, filed on Feb. 1, 2019, now Pat. No. 10,815,591, which is a division of application No. 16/156,140, filed on Oct. 10, 2018, now Pat. No. 10,443,161.

(30) Foreign Application Priority Data

Apr. 14, 2018 (IN) ..... 2018210143202

(51) Int. Cl.

| | |
|---|---|
| ***D03D 1/00*** | (2006.01) |
| ***D03D 13/00*** | (2006.01) |
| ***D03D 23/00*** | (2006.01) |
| *D03D 25/00* | (2006.01) |

(52) U.S. Cl.

CPC ..... *D03D 13/004* (2013.01); *D03D 1/0017* (2013.01); *D03D 23/00* (2013.01)

(58) Field of Classification Search

CPC .. D03D 15/00; D03D 15/0027; D03D 1/0017; D03D 15/0077; D03D 1/00; D03D 25/00; D06B 3/10; D06B 1/00; D06B 21/00; D06C 27/00; A47C 27/146; A47C 31/123; A47C 27/122

See application file for complete search history.

(56) References Cited

U.S. PATENT DOCUMENTS

| | | | | | |
|---|---|---|---|---|---|
| 4,298,122 | A * | 11/1981 | Ekelund | B65H 75/28 | D15/78 |
| 4,569,107 | A * | 2/1986 | Pomeroy | D02H 5/02 | 8/151.2 |
| 4,610,059 | A * | 9/1986 | Seaborn | D02H 13/24 | 28/187 |
| 4,819,310 | A * | 4/1989 | Beerli | D02H 13/24 | 700/130 |
| 4,974,301 | A * | 12/1990 | Beerli | D02H 3/02 | 28/191 |

(Continued)

*Primary Examiner* — Robert H Muromoto, Jr.

(57) ABSTRACT

Provided is a high thread/yarn count woven textile fabric made of recycled multi-filament yarns. The high thread/yarn count woven textile fabric includes a plurality of warps, and a plurality of wefts. Further, the high thread/yarn count woven textile fabric has 400 to 3000 ends per inch in the warp, where at least two recycled separable multi-filament parallel ends are woven in groups in the warp. The recycled separable multi-filament parallel ends are separable from the other ends. Furthermore, the thread/yarn count of the fabric is between 500 to 3000. The invention uses a simple and direct process to achieve a good quality textile having a high thread/yarn count at low production cost.

19 Claims, 3 Drawing Sheets

(56) References Cited

U.S. PATENT DOCUMENTS 6,119,732 A * 9/2000 Lindblom ..... D03D 49/04 139/97
6,581,257 B2 * 6/2003 Burton ..... B65H 49/34 28/190
6,845,550 B2 * 1/2005 Kimura ..... D02H 5/02 28/190
8,733,075 B2 * 5/2014 Mandawewala ..... D02G 3/38 139/1 R
9,138,066 B1 * 9/2015 Goenka ..... A47C 31/105
9,357,863 B1 * 6/2016 Goenka ..... A47G 9/0292
9,410,271 B2 * 8/2016 Goenka ..... D03D 13/004
9,504,334 B2 * 11/2016 Goenka ..... A47C 27/122
9,524,589 B1 * 12/2016 Goenka ..... G06T 1/0007
9,677,201 B2 * 6/2017 Mandawewala ..... D02G 3/22
9,677,202 B2 * 6/2017 Mandawewala ..... D03D 15/217
9,677,205 B2 * 6/2017 Mandawewala ..... D06C 19/00
9,702,064 B2 * 7/2017 Goenka ..... D03D 15/49
9,732,455 B2 * 8/2017 Goenka ..... D06B 21/00
9,795,226 B2 * 10/2017 Goenka ..... A47C 27/146
9,811,804 B1 * 11/2017 Goenka ..... G06Q 50/04
10,072,364 B2 * 9/2018 Goenka ..... D03D 27/08
10,101,289 B2 * 10/2018 Goenka ..... G01N 27/048
10,443,161 B1 * 10/2019 Gupta ..... D03D 13/004
10,815,591 B2 * 10/2020 Gupta ..... D03D 23/00
2002/0129474 A1 * 9/2002 Burton ..... B65H 49/34 28/172.1
2003/0196303 A1 * 10/2003 Kimura ..... B65H 69/00 28/192
2004/0128811 A1 * 7/2004 Mandawewala ..... D02G 3/406 28/159
2004/0129332 A1 * 7/2004 Wang ..... D03D 15/267 139/116.1
2004/0131821 A1 * 7/2004 Mandawewala ..... D02G 3/406 57/238
2007/0266535 A1 * 11/2007 Storchenegger ..... D02H 13/18 28/191
2009/0126823 A1 * 5/2009 Yengkhom ..... D03D 41/00 139/11
2009/0173055 A1 * 7/2009 Silver ..... D02G 3/04 57/400
2010/0018888 A1 * 1/2010 Hamilton ..... B65D 85/182 206/494
2011/0053449 A1 * 3/2011 Kulkarni ..... B32B 5/024 156/494
2011/0070791 A1 * 3/2011 Kulkarni ..... D04H 1/498 442/1
2011/0111164 A1 * 5/2011 Mandawewala ..... D06N 7/0073 156/72
2014/0248461 A1 * 9/2014 Mandawewala ..... D02G 3/38 428/76
2014/0352073 A1 * 12/2014 Goenka ..... D06M 15/256 5/691
2017/0145610 A1 * 5/2017 Kulkarni ..... B32B 5/06

* cited by examiner

HIGH THREAD/YARN COUNT WOVEN TEXTILE FABRIC AND PROCESS OF PREPARATION THEREOF

CROSS REFERENCE TO RELATED APPLICATIONS

The present patent application is a Continuation-in-part of Divisional patent application Ser. No. 16/265,537 filed on Feb. 1, 2019 of patent application Ser. No. 16/156,140 filed on Oct. 10, 2018, which claims priority to the Indian Patent Application No. 201821014302 filed on Apr. 14, 2018, all of which are herein incorporated by reference in their entirety.

TECHNICAL FIELD

The present invention relates to high thread/yarn count textile fabric and processing of preparation thereof.

Definition

As used in the present invention, the following term is generally intended to have the meaning as set forth below, except to the extent that the context in which they are used indicate otherwise.

Warp and Weft are terms for the two basic components used in weaving to turn thread/yarn into fabric.

Warp refers to a basic component of textile that is held stationary in tension in a frame or loom, lengthwise or longitudinally, for weaving to convert thread/yarn into a fabric.

Weft or Woof refers to another basic component of textile which is drawn through and inserted over-and-under the Warp in a transverse direction to the Warp.

A Pick or Fill refers to a single Weft thread/yarn.

An end refers to a single Warp thread/yarn.

Picks per inch refers to the number of the Welt thread/yarns per inch of a woven textile fabric.

Ends per inch refers to the number of Warp thread/yarns per inch of a woven textile.

Thread/yarn Count refers to the total number of Ends and number of Picks woven in the textile per square inch, and is calculated by adding the total number of Warp Ends per inch and Weft Picks per inch.

High thread/yarn count refers to a thread/yarn count in the range of 300 to 3000 thread/yarns per inch.

Parallel Picks: Two or more Picks that are crossing the warp simultaneously and going over and under the warp Ends together. These Picks are parallel to each other and can be separated from each other as they are not twisted. The parallel Picks are inserted together during a weft insertion.

Parallel Ends: Two or more Ends going over and under the Picks together in a group. These Ends can be separated from each other since they are parallel and not twisted.

BACKGROUND

Conventionally, good quality cotton textiles with high thread count are obtained from compact combed cotton Yarns having finer thread like 50s variety or above. However, compact combed Yarns are very costly than the combed ones and also Yarns having higher than 50s quality are expensive than 20s or 30s varieties. The high cost of Yarns also increases the cost of the final fabric.

The prior art teaches introduction of simultaneous insertions of multi-filament polyester Yarns in the Weft in each Pick. However, such processes do not address the cost issues as they use cotton Yarns in the Warps.

Another problem is that the speed of the looms using cotton in the Warps cannot be increased to a great extent as cotton is a spun Yarn.

There is, therefore, felt a need for a simple and direct method for preparing inexpensive woven textile having a high thread/yarn count.

Objects

Some of the objects of the present invention, which at least one embodiment herein satisfies, are as follows.

An object of the present invention is to ameliorate one or more problems of the prior art or to at least provide a useful alternative.

An object of the present invention is to provide a textile having a high thread/yarn count fabric of good quality.

Another object of the present invention is to provide a simple and economical process for preparing textile having a high thread/yarn count and good quality.

Still another object of the present invention is to provide a high thread/yarn count textile having varied dyeability of the recycled component yarns.

Other objects and advantages of the present invention will be more apparent from the following description, which is not intended to limit the scope of the present invention.

SUMMARY

This summary is provided the introduce the concept related to high thread/yarn count woven textile fabric made of recycled multi-filaments yarns. The summary in neither intended to identify essential features of the present invention nor is it intended for use in determining or limiting the scope of the present invention.

In an embodiment of the present invention, a high thread/yarn count woven textile fabric made of recycled multi-filaments yarns is provided. The high thread/yarn count woven textile fabric includes a plurality of warps, and a plurality of wefts. Further, the high thread/yarn counts woven textile fabric having 400 to 3000 ends per inch in the warp, wherein at least two recycled separable multi-filament parallel ends are woven in groups together in the warp. The recycled separable multi-filament parallel ends are separable from another end. Furthermore, the thread/yarn count of the fabric is between 500 to 3000.

Typically, the textile comprises at least 50% by weight of at least one material selected from the group consisting of cotton, viscose, polylactic acid, soy and bamboo.

The plurality of recycled multi-filament Yarns are selected from the group consisting of partially oriented Yarn (POY), medium oriented Yarn (MOY) and fully oriented Yarn (FOY), draw textured Yarns (DTY).

In an embodiment of the present invention, a high thread/yarn count woven textile fabric is provided. The high thread/yarn count woven textile fabric includes a plurality of warps, and a plurality of wefts. Further, the high thread/yarn count woven textile fabric have 250 to 3000 ends per inch in the warp. Furthermore, at least two recycled separable multi-filament parallel ends are woven in groups together in the warp. The recycled separable multi-filament parallel ends are separable from other end. Further, the thread/yarn count of the fabric is between 300 to 3000, and at least one weft of the plurality of wefts includes combed cotton.

In another embodiment of the present invention, the textile fabric includes at least one weft of the plurality of wefts which is selected from the group consisting of combed cotton and carded cotton.

In another embodiment of the present invention, the textile fabric includes at least 400 ends per inch in the warp which are recycled multi-filament parallel ends having a denier range of 5 to 50 denier.

In another embodiment of the present invention, a bedding comprising of high thread/yarn count woven textile fabric is provided.

In another embodiment of the present invention, a process for preparing high thread/yarn count textile fabric is provided. The process includes having a thread/yarn count in the range of 300 to 3000 thread/yarns per inch. Further, the process includes the steps of winding parallel ends of separable multi-filament yarns on a beam to form a plurality of warp ends; and weaving the plurality of parallel ends with at least one of pick insertion on a loom to obtain a woven textile, wherein the fabric comprises of 250 to 3000 ends per inch in the warp.

In another embodiment of the present invention, the loom is any one selected from the group consisting of shuttle loom, air jet loom, water jet loom, rapier loom, projectile loom, jacquard loom and dobby loom.

In another embodiment of the present invention, the fabric has type of weave selected from the group consisting of plain weave, twill weave, satin weave and basket weave.

In another embodiment of the present invention, the process includes the winding 400 to 3000 yarn ends per inch of recycled separable multi-filaments yarns on a beam to form a plurality of warp ends comprises winding 500 to 3000 yarn ends per inch of recycled separable multi-filaments yarns on a beam to form the plurality of warp ends.

In another embodiment of the present invention, the process includes weaving the plurality of warp ends in groups includes weaving the plurality of warp ends such that the plurality of warp ends are parallel to one another.

BRIEF DESCRIPTION OF THE ACCOMPANYING DRAWING

The high thread/yarn count textile of the present invention will now be described with the help of the accompanying drawing, in which.

DETAILED DESCRIPTION

Figure 1:
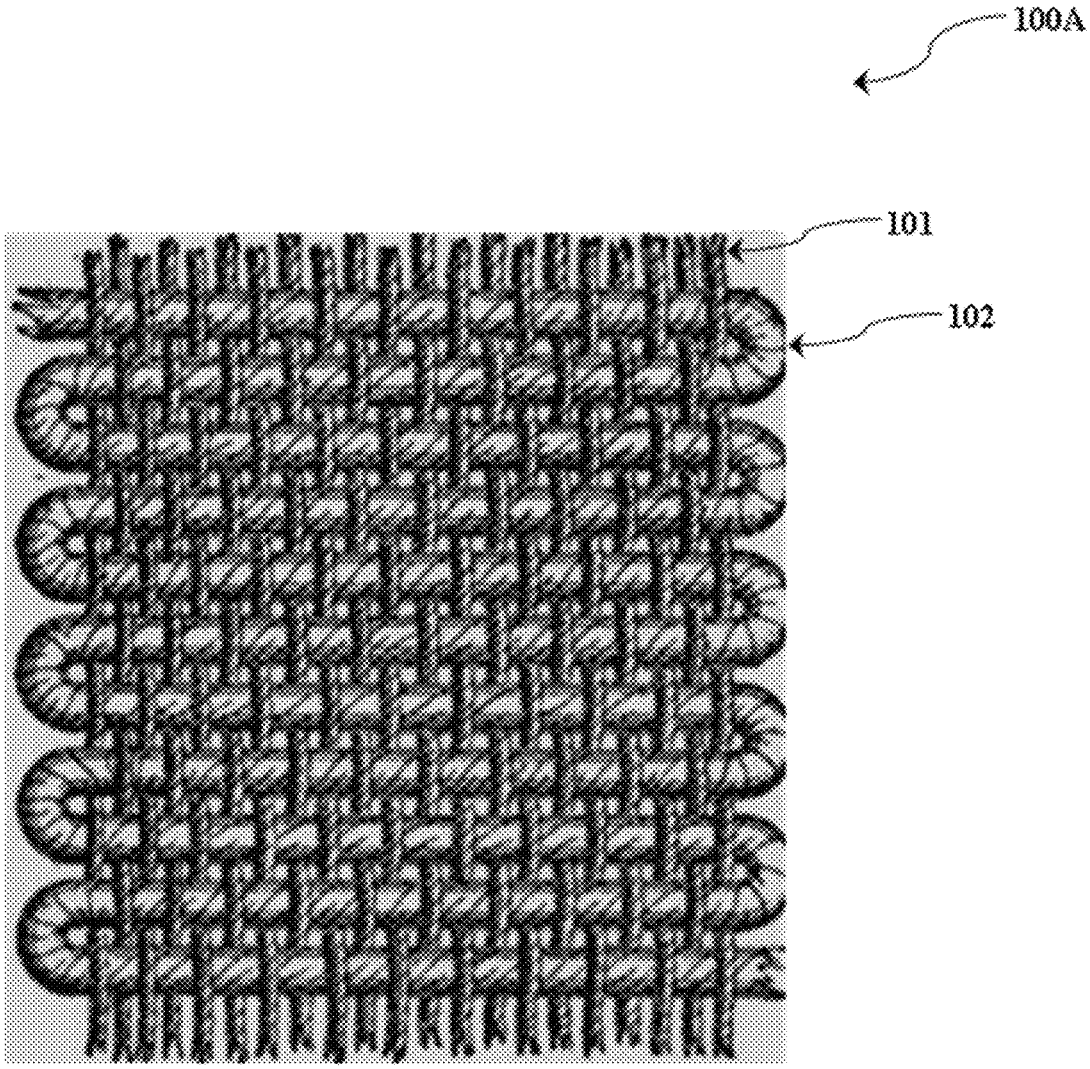
FIG. 1 illustrates a textile (100A) comprising a plurality of warps (ends) and a plurality of wefts (picks), according to an implementation of the present invention.
Figure 2:
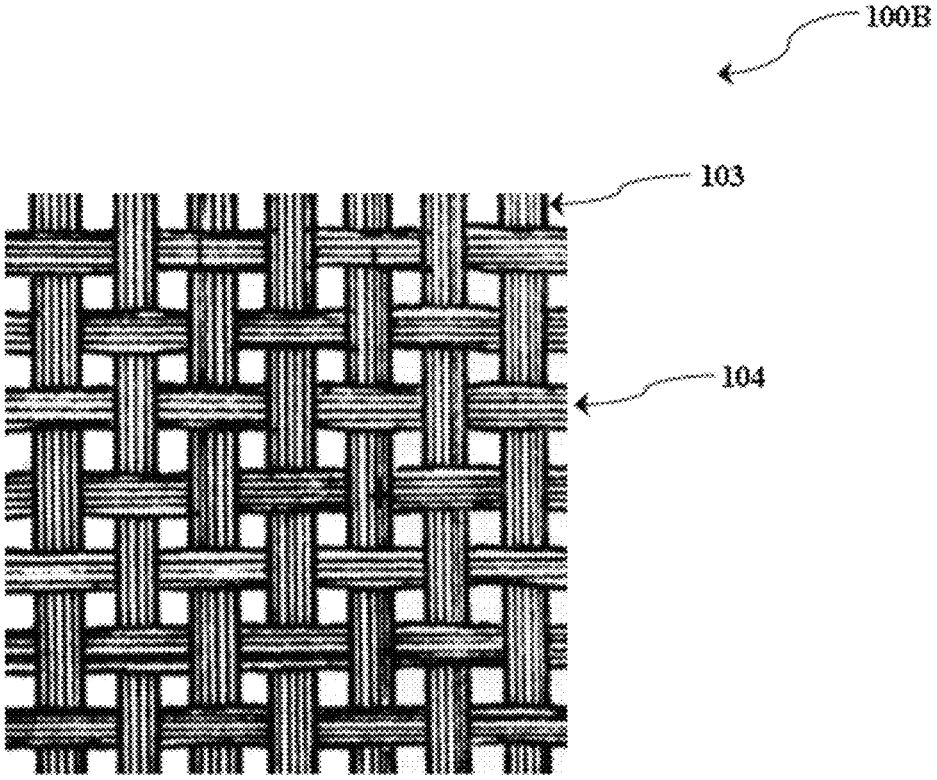
FIG. 2 illustrates a textile (100B) showing multiple parallel Ends in Warp and multiple parallel Picks in Weft, according to an implementation of the present invention.
Figure 3:
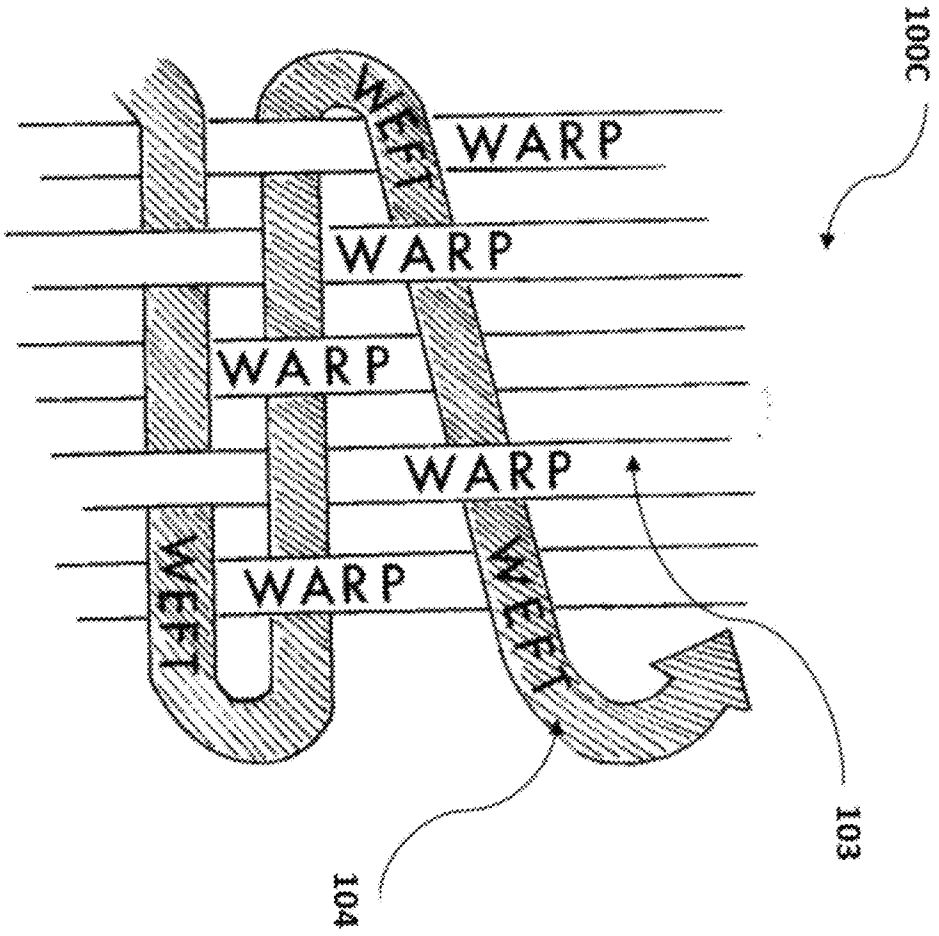
FIG. 3 illustrates a textile (100C) comprising a plurality of Warps (Ends) and a plurality of Wefts (Picks) in more simpler and clear way, according to an implementation of the present invention.

The invention will now be described with reference to the accompanying drawings and embodiments which do not limit the scope and ambit of the invention. The description provided is purely by way of example and illustration.

One or more embodiments are provided so as to thoroughly and fully convey the scope of the present invention to the person skilled in the art. Numerous details, are set forth, relating to specific components, and methods, to provide a complete understanding of embodiments of the present invention. It will be apparent to the person skilled in the art that the details provided in the embodiments should not be construed to limit the scope of the present invention. In some embodiments, well-known processes, well-known apparatus structures, and well-known techniques are not described in detail.

The terminology used, in the present invention, is only for the purpose of explaining a particular embodiment and such terminology shall not be considered to limit the scope of the present invention. As used in the present invention, the forms "a," "an" and "the" may be intended to include the plural forms as well, unless the context clearly suggests otherwise. The terms "comprises," "comprising," "including," and "having," are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present invention is not to be construed as necessarily requiring their performance as described or illustrated. It is also to be understood that additional or alternative steps may be employed.

The FIGs accompanied is for the purpose of explanation about technical terms used in fabric to the person not skilled in the textile, fabric technology.

There is a rising demand of cotton rich fabrics of higher thread count. In particular, the sheeting industry has good demand for high thread count sheets and for the same what is conventionally used is cotton in the warp and polyester in the weft.

As an example, to make 1050 thread count cotton rich satin weave fabric as per the prior art one of the constructions of a good quality fabric at cheap price would be:

a) Warp: 60s Compact Combed Cotton, 150 ends per inch
b) Weft: 75 Nos Insertions per inch wherein each insertion is of 12 parallel picks of 15 denier multifilament Yarns. So, total 900 picks per inch.
c) Thread Count=150 (Warp)+12×75 (Weft)=1050 threads count per inch Now to make good compact fabric 150 ends per inch are used and for maintain the cotton ratio just above 50% and 60s compact cotton yarn needs to be used in the warp when 15 denier is used in the weft. This increases the cost.

In this respect, the present invention discloses a new product of high thread count fabric having recycled multiple parallel multi-filament yarns in the warp and spun fiber yarns in the wefts and a method to manufacture the same.

The present invention overcomes the problem of increased cost of high thread count cotton rich fabric and makes it easy to manufacture the same fabric in low production cost way.

According to present invention, the fabric product is made by using recycled separable parallel ends in the warp to increase thread count instead of using in the weft which is done by warping multiple recycled multifilament parallel ends on a beam. The recycled parallel ends may come from one cone or for multiple cones and preferably from one cone.

Depending on the requirement, the recycled parallel ends are warped on a beam and then woven into a fabric on any loom.

Optionally, sizing the recycled multi-filament parallel yarn ends is recommended for increasing the speed of the weaving and increasing efficiency or to run super fine recycled yarns in the denier range of 5 to 50 and preferably recycled yarns of denier range 5 to 30. Sizing is known terminology used in the textile industry. The sizing is used in textile manufacturing to change the absorption and wear characteristics of those materials. Textile warp sizing, also known as tape sizing, of the warp yarn is essential to reduce breakage of the yarn and thus, production stops on the weaving machine. On the weaving machine, the warp yarns are subjected to several types of actions i.e. cyclic strain, flexing, abrasion at various loom parts and inter yarn friction.

With sizing, the strength—abrasion resistance—of the recycled yarn will improve and the hairiness of yarn will decrease. The degree of improvement of strength depends on adhesion force between fiber and size, size penetration as well as encapsulation of the recycled yarn. Different types of water soluble polymers called textile sizing agents/chemicals such as modified starch, polyvinyl alcohol (PVA), carboxymethyl cellulose (CMC), acrylates are used to protect the yarn. Also wax is added to reduce the abrasiveness of the warp yarns. The type of yarn material (e.g. cotton, polyester, linen), the thickness of the yarn, type of weaving machinery will determine the sizing recipe.

The sizing liquor is applied on warp yarn with a warp sizing machine. After the weaving process, the fabric is desized (washed). Sizing may be done by hand, or in a sizing machine.

For this, suitable sizing material is used depending on the filament polymer. This sizing is preferably done by sizing all the parallel ends together in a bunch. Sizing the parallel ends together makes all the filaments in the ends stick to each other in the sized group and reduces the rupture while weaving. This sizing is later on removed by washing or other means to get all the parallel separable ends in the finish fabric.

The fabric can have any type of weave which can be either plain weave, twill weave, satin weave or basket weave, or any other weave can be used.

Following example illustrates the high thread count textile fabric as provided in the present invention:

Using the following construction, the cost of fabric is reduced and a High-Quality High thread count Textile Fabric is achieved:

a) Weft: 75 Insertions per inch of 60s combed cotton in 2 parallel. So, totally 150 picks per inch.
b) Warp: 150 Nos per inch and each area having 6 parallel ends of 15 denier recycled multifilament yarns. So, totally 900 ends per inch
c) Thread Count=6*150 (Warp)+75×2(Weft)=1050 threads count per inch The above example would reduce the fabric cost because of the following reasons:

a) compact cotton is not used since it is not required to be used and combed cotton is cheaper by about 10% then compact combed.
b) the width of the grey fabric that is weaved can be reduced as recycled filament yarns shrink more in processing and cotton in weft will not shrink that much. So, if the user is making 124 inches conventionally with polyester filament in weft, with the present invention, the user make in 120 inches with cotton weft and the fabric width after dyeing would remain same.
c) the user can use low cost recycled yarns in selvage such as 90 or 80 denier multi-filament yarns as same shrinkage polyester yarns are available as fine denier yarns.

An even lower cost of fabric is achieved using the following construction for high number ends per inch warp and with negligible change of feel maintaining the cotton ratio:

a) Weft: 75 insertions per inch of 30s combed cotton
b) Warp: 163 nos per inch and each area having 6 parallel ends of 15 denier recycled multi-filament yarns. So, totally 978 ends per inch.
c) Thread Count=6*163 (Warp)+75 (Weft)=1053 threads count per inch.

This would make the cost fabric even lower as the cost of 60s combed is very high compared to 30s Combed. Also, there would be other cost reductions as explained above and many more provided below.

Also, the user can additionally use cotton or other recycled fiber yarns such as material selected from a group of cotton yarn, bamboo yarns, soy yarns, pla, viscose yarns, polyamide yarns, polypropylene yarns, polyester yarns, etc, in the warp for added feel and dyeing possibilities if required.

For Example, by taking 1-inch cotton in warp and then next adjacent inch of recycled separable multi-filament parallel ends in the warp, one could easily create stripes of 2 colors when the fabric is cross dyed and increase the thread count also simultaneously.

Or one could use alternative ends of cotton and polyester to give mélange look to the fabric which cross dyed.

Further, there are so many other possible varieties which can be made using the present invention.

With the easy availability of recycled superfine denier yarns such as 5 denier to 15 denier in many parallel, it is much easier to increase the thread count of a fabric by just inserting some ends of such separable yarns in the warp.

In an embodiment of the present invention, a high thread/yarn count woven textile fabric made of recycled multi-filaments yarns is provided. The high thread/yarn count woven textile fabric includes a plurality of warps, and a plurality of wefts. Further, the high thread/yarn count woven textile fabric having 400 to 3000 ends per inch in the warp, wherein at least two recycled separable multi-filament parallel ends are woven in groups together in the warp. The recycled separable multi-filament parallel ends are separable from other end. Furthermore, the thread/yarn count of the fabric is between 500 to 3000.

Further, the warp ends can also be of material selected from the group consisting of polyester, polyamide, polypropylene and polylactic acid.

Typically, the textile comprises at least 50% by weight of at least one material selected from the group consisting of cotton, viscose, polylactic acid, soy and bamboo.

The plurality of recycled multi-filament yarns are selected from the group consisting of partially oriented Yarn (POY), medium oriented Yarn (MOY) and fully oriented Yarn (FOY), draw textured Yarns (DTY)

The fabric according to present invention will be typically used for making a bedding article.

In an embodiment of the present invention, the present invention with the help of the above examples discloses a process for preparing high thread/yarn count textile fabric having a thread/yarn count in the range of 300 to 3000 thread/yarns per inch, said process comprising the steps of:

(i) winding 400 to 3000 yarn ends per inch of separable parallel ends of recycled multi-filament yarns on a beam to form a plurality of warp ends;
(ii) weaving said plurality of warp ends in groups from said beam with at least one pick insertion on a loom to obtain a woven textile, wherein the woven textile has a plurality of weft picks, and (iii) using combed cotton without any compact cotton to form the plurality of weft picks, wherein the warp ends are at least two times the weft picks.

In another embodiment, the loom is any one selected from the group consisting of shuttle loom, air jet loom, water jet loom, rapier loom, projectile loom, jacquard loom and dobby loom.

In another embodiment, the fabric has type of weave selected from the group consisting of plain weave, twill weave, satin weave and basket weave.

Technical Advancements

The present invention described herein above has several technical advantages, including but not limited to, the realization of a woven textile that:

has made of recycled multi-filament yarns;

has high thread/yarn count;

is less costly and has good quality; and increased speed of manufacturing.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the invention to achieve one or more of the desired objects or results.

Any discussion of documents, acts, materials, devices, articles or the like that has been included in this specification is solely for the purpose of providing a context for the invention. It is not to be taken as an admission that any or all of these matters form a part of the prior art base or were common general knowledge in the field relevant to the invention as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the invention, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the invention. These and other changes in the preferred embodiment as well as other embodiments of the invention will be apparent to those skilled in the art from the invention herein, whereby it is to be distinctly understood that the foregoing descriptive matter is to be interpreted merely as illustrative of the invention and not as a limitation.

The invention claimed is:

1. A high thread/yarn count woven textile fabric comprising:

a plurality of warps, and a plurality of wefts;

wherein the fabric having 400 to 3000 ends per inch in the warp;

wherein at least two recycled separable multi-filament parallel ends are woven in groups together in the warp, wherein the recycled separable multi-filament parallel ends are separable from other end; and wherein the thread/yarn count of the fabric is between 500 to 3000.

2. The textile fabric according to claim 1, wherein the ends is of recycled material selected from the group consisting of polyester, polyamide, polypropylene and polylactic acid.

3. The textile fabric according to claim 1, wherein the fabric may have combination of warps of the ends and warps of recycled material selected from a group of cotton yarn, bamboo yarns, soy yarns, pla, viscose yarns, polyamide yarns, polypropylene yarns, and polyester yarns.

4. The textile fabric according to claim 1, wherein the textile fabric comprises at least 50% by weight of at least one recycled material selected from the yarn group consisting of cotton, viscose, polylactic acid, soy and bamboo.

5. The textile fabric according to claim 1, wherein the recycled multi-filament parallel ends are selected from the group consisting of partially oriented Yarn (POY), medium oriented Yarn (MOY), fully oriented Yarn (FOY), and draw textured Yarns (DTY).

6. The textile fabric according to claim 1, wherein the fabric has atleast one of plain weave, twill weave, satin weave or basket weave, or any other weave.

7. The textile fabric according to claim 1, wherein the ends have a denier of range 5 to 50 denier.

8. The textile fabric according to claim 1, wherein the ends are drawn into a group of parallel ends in the warp from at least one package having multiple recycled separable multi-filament parallel yarns, or wherein the ends are drawn into a group of parallel ends in the warp from two or more packages having at least one recycled separable multi-filament yarns.

9. The textile fabric according to claim 1, wherein the warp consists of 250 to 3000 thread/yarns per inch of recycled separable multi-filament parallel yarn and weft consists of 30 to 300 picks per inch of cotton Yarn, and wherein the recycled multi-filament yarn comprises of at least one of Polyester, Polyamide, Polypropylene, PLA, etc., and wherein the fabric has at least 50% by weight of cotton yarn.

10. The textile fabric according to claim 1, wherein the warp consists of 250 to 2000 thread/yarns per inch of recycled separable multi-filament parallel yarn and the weft consists of 30 to 250 picks per inch of cotton yarn, and wherein the recycled multi-filament yarn comprises at least one of Polyester, Polyamide, Polypropylene, PLA, etc., and wherein the fabric has at least 50% by weight of cotton yarn.

11. The textile fabric according to claim 1, wherein at least one weft of the plurality of wefts is selected from the group consisting of combed cotton and carded cotton.

12. The textile fabric according to claim 1, wherein at least 400 ends per inch in the warp are recycled multi-filament parallel ends having a denier range of 5 to 50 denier.

13. A bedding comprising of high thread/yarn count woven textile fabric according to claim 1.

14. A high thread/yarn count woven textile fabric comprising:

a plurality of warps, and a plurality of wefts;

wherein the fabric having 250 to 3000 ends per inch in the warp;

wherein at least two recycled separable multi-filament parallel ends are woven in groups together in the warp, wherein the recycled separable multi-filament parallel ends are separable from other end;

wherein the thread/yarn count of the fabric is between 300 to 3000, and wherein at least one weft of the plurality of wefts includes combed cotton.

15. A process for preparing high thread/yarn count textile fabric having a thread/yarn count in the range of 300 to 3000 thread/yarns per inch, the process comprising the following steps:

(i) winding 400 to 3000 yarn ends per inch of separable parallel ends of recycled multi-filament yarns on a beam to form a plurality of warp ends;

(ii) weaving the plurality of warp ends in groups from the beam with at least one pick insertion on a loom to obtain a woven textile, wherein the woven textile has a plurality of weft picks, and (iii) using combed cotton without any compact cotton to form the plurality of weft picks, wherein the warp ends are at least two times the weft picks.

16. The process according to claim 15, wherein the process further comprises a step of sizing in groups the warp ends with a sizing material after step 15.(i).

17. The process according to claim 15, wherein the process further comprises a step of applying on the ends in the warp after step 15.(i) at least one compound selected from the group consisting of oil and anti-static agents.

18. The process according to claim 15, wherein the winding 400 to 3000 yarn ends per inch of recycled separable multi-filaments yarns on a beam to form a plurality of warp ends comprises winding 500 to 3000 yarn ends per inch of recycled separable multi-filaments yarns on a beam to form the plurality of warp ends.

19. The process according to claim 15, wherein the weaving the plurality of warp ends in groups includes weaving the plurality of warp ends such that the plurality of warp ends are parallel to one another.

* * * * *